US005571389A

United States Patent [19]

Kerampran

[11] Patent Number: 5,571,389

[45] Date of Patent: Nov. 5, 1996

[54] DEVICE FOR THE ELECTROCHEMICAL TREATMENT ESPECIALLY THE LOCAL ELECTROCHEMICAL TREATMENT, OF CONDUCTIVE SUBSTRATE

[75] Inventor: Patrick K. Kerampran, Vitre, France

[73] Assignee: Dalic, Vitre, France

[21] Appl. No.: 364,681

[22] Filed: Dec. 13, 1994

[30] Foreign Application Priority Data

Dec. 16, 1993 [FR] France ..... 93 15166

[51] Int. Cl.[6] ..... C25D 17/00

[52] U.S. Cl. ..... 204/224 R; 204/225; 204/237; 204/275; 204/278

[58] Field of Search ..... 204/224 R, 225, 204/237, 275, 278

[56] References Cited

U.S. PATENT DOCUMENTS

| | | | |
|---|---|---|---|
| 3,294,664 | 12/1966 | Franklin | 204/224 |
| 4,702,811 | 10/1987 | Murata et al. | 204/206 |
| 4,952,296 | 8/1990 | Wigenfeld et al. | 204/206 |
| 5,382,343 | 1/1995 | Zwerner | 204/224 |

*Primary Examiner*—Arun S. Phasge
*Attorney, Agent, or Firm*—Anthony J. Casella; Gerald E. Hespos

[57] ABSTRACT

Device for the electrochemical treatment, in particular localized, of a conducting substrate, which comprises a casing provided with an opening and delimiting a space, an electrode arranged in this space and intended to be connected to one of the terminals of a source of electric current, the conducting substrate being intended to be connected to the other terminal of this source, and an electrolyte inlet and an electrolyte outlet, both communicating with the said space, characterized in that it moreover comprises a body made of absorbent, flexible material which does not conduct electricity and which is permeable to gases and liquids, this body being in contact with the said electrode and closing off the said opening, projecting beyond the latter, a first pump mounted on the said electrolyte inlet and a second pump mounted on the said electrolyte outlet, the flow rate of the second pump being greater than that of the first pump and fixed in relation to that of the first pump, so as to create an underpressure in the said space.

17 Claims, 2 Drawing Sheets

DEVICE FOR THE ELECTROCHEMICAL TREATMENT ESPECIALLY THE LOCAL ELECTROCHEMICAL TREATMENT, OF CONDUCTIVE SUBSTRATE

BACKGROUND OF THE INVENTION

The present invention concerns a device for the electrochemical treatment, in particular localized, of a conducting substrate by movement over the said substrate, capable of being used in any position, which comprises a casing provided with an opening and delimiting a space, an electrode being arranged in this space and intended to be connected to one of the terminals of a source of electric current, the conducting substrate being intended to be connected to the other terminal of this source, and an electrolyte inlet and electrolyte outlet, both communicating with the said space.

Such a device enables in particular electrochemically formed metal coatings to be obtained and localized deposits to be achieved or retouching to be carried out on metal surfaces. In the automobile, aeronautical or railway industries, surfaces have frequently to be prepared before assembly or before another surface treatment. In these and many other industries, including the plastics or mechanical industries, metal parts or surfaces suffer wear, scratches, abrasion or corrosive damage which justify such localized metal retouching.

Such electrochemical treatment devices are already known such as, for example, devices of the pad type, as well as devices making use of chambers or cells with electrolyte circulation or gels in order to avoid electrolyte leakage.

These devices always however present risks of leakage during treatment, associated with the quality of the seal provided by joints, or during cleaning following treatment (in the case of gels) and risks associated with uniformity of treatment. Thus electrolyte leakages, in particular during movement of the device over the substrate, present a real danger for adjacent areas which are not to be treated and for the operator, by reason of the often corrosive nature of the electrolytes used.

SUMMARY OF THE INVENTION

The present invention consequently aims at remedying the abovementioned disadvantages and, for this purpose, it suggests a device such as defined in the first paragraph of this description which is characterized in that it furthermore comprises a body made of absorbent, flexible material which does not conduct electricity and which is permeable to gases and liquids, this body being in contact with the said electrode and closing off the said opening, projecting beyond the latter, a first pump being mounted on the said electrolyte inlet and a second pump being mounted on the electrolyte outlet, the flow rate of the second pump being greater than that of the first pump so as to create an underpressure in the said space.

It will be understood that owing to this arrangement, the electrolyte arriving in the inner space of the tool is partly retained by the body made of absorbent material with which it is in contact, thus ensuring electrical continuity between the electrode and the conducting substrate to be treated. Moreover, by reason of the underpressure existing within this space, excess electrolyte is continuously evacuated. The electrolyte is thus continuously renewed, which contributes to the dissipation of heat generated by the electrochemical treatment. Furthermore, and still by reason of this underpressure, the outside air is continuously sucked through all the mass of the body made of absorbent material, which prevents any unintended outflow through the said opening, whatever the position in which the device is used. Furthermore, this suction of air ensures cooling of the electrolyte which heats up under the application of high intensity currents. In addition, the device in accordance with the invention enables not only plane, concave or convex surfaces to be treated, but also any edges which the substrate to be treated may present.

According to an embodiment of the device of the invention, the said electrolyte inlet opens into the said space in proximity to the body made of absorbent material, it being specified that the electrolyte inlet preferably comprises at least one bore made in the electrode and opening on the surface of this electrode, in the contact area of the latter with the said body made of absorbent material. In this way, the electrolyte, as soon as it leaves the electrolyte inlet, immediately reaches the body made of absorbent material so as to spread uniformly throughout all the mass of this body. Furthermore, the said electrolyte outlet originates in the said space preferably in proximity to the said body made of absorbent material.

According to another embodiment, the electrolyte inlet and the electrolyte outlet each comprises a flexible tube and the said first and second pumps are peristaltic pumps which more precisely comprise two rotors provided with peripheral rollers and are mounted axially on a shaft capable of being rotated, the rollers of one of the rotors operating on the flexible tube of the electrolyte inlet and the rollers of the other rotor operating on the flexible tube of electrolyte outlet, the diameters of the said rotors and/or the said flexible tubes being selected to create the said underpressure in the said space.

In this way, the circulation flow rate in the electrolyte inlet and the flow rate in the electrolyte outlet are associated and set once and for all. This enables any flow rate control to be dispensed with during use of the device and the latter is immediately operational without the need to carry out any adjustment whatsoever. In addition, electrolyte input and output may be made to cease simultaneously by a single operation, that is to say simply by stopping the motor driving the shaft.

The absorbent material of which the body used in the invention consists may in particular be made of a material having chemical resistance properties as regards the electrolyte and heat resistant properties within the working temperature range (from 15° C. to 60° C.). This material should in addition be a non conductor of electricity and be permeable to gases and liquids and finally it should be selected so as not to scratch the substrate to be treated. It may consist for example of polyester wadding or of a woven or non-woven textile material, consisting of nylon fibres or felt.

It should be added that the source of electrical current may be a source of pulsed current or of direct current.

The device such as defined above enables all types of electrochemical treatments to be carried out. It may first of all involve carrying out electrolytic deposition and in this case the substrate to be treated will constitute the cathode and the electrode of the device will constitute the anode, this electrode being made of a material which is insoluble under the treatment conditions. It may equally involve a metal stripping treatment using a stripping electrolyte, the substrate to be treated being chosen as the anode and the electrode of the device as the cathode. Finally it may be an anodizing treatment of any substrate to be treated consisting of an oxidizable material such as aluminium, titanium and their alloys; in this application the substrate to be treated will be chosen as the anode and the electrode of the device as the cathode.

A method of carrying out the invention is described below as a non-limiting example with reference to the attached drawings, FIG. 1 of which is a diagrammatic sectional view of the treatment device associated with a diagrammatically represented electrical installation and FIGS. 2 and 3 are partial diagrammatic representations of the peristaltic pumps used in a preferred embodiment.

Figure 1:
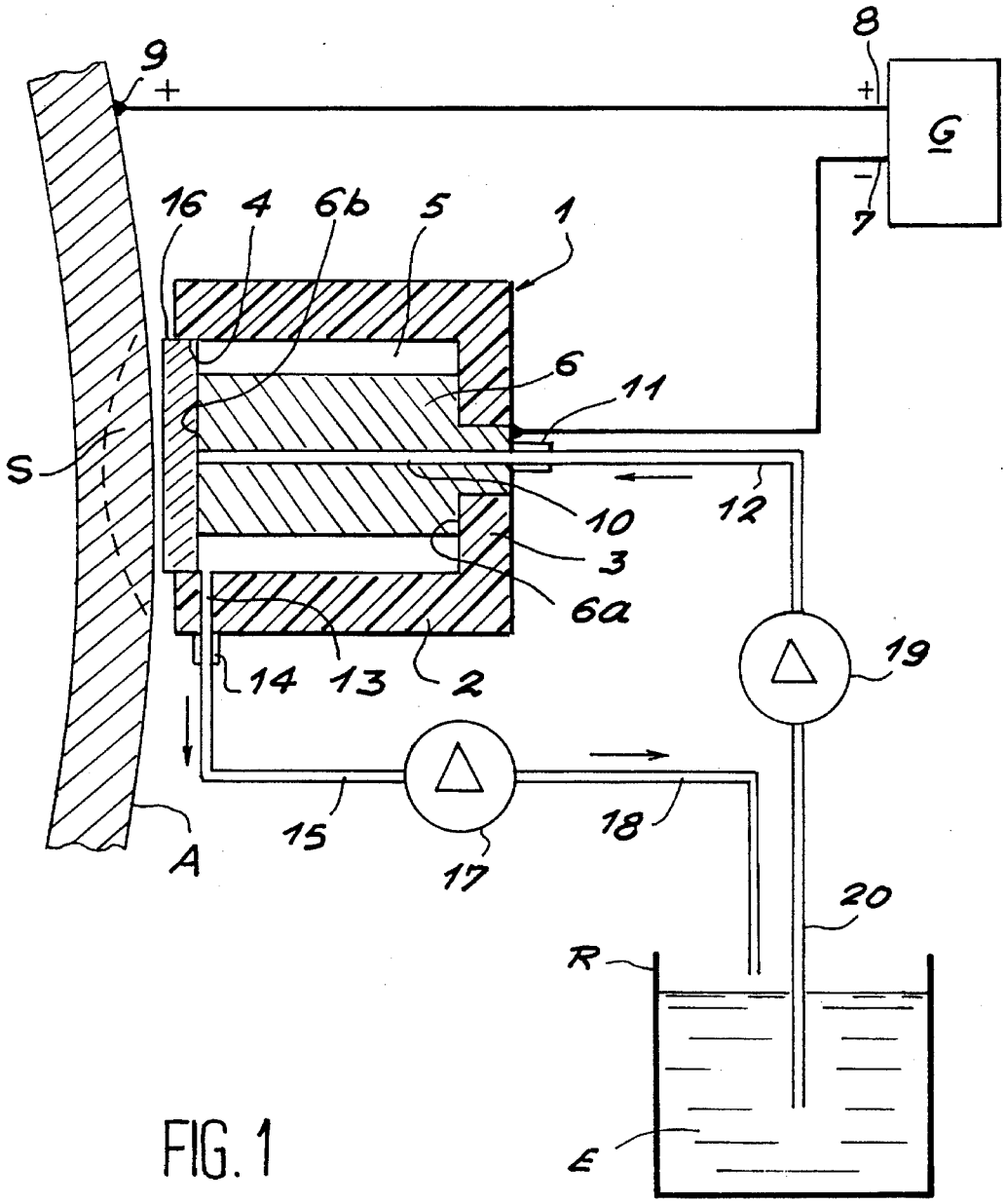
FIG. 1 represents more precisely a device according to the invention for anodic oxidation enabling the surface S of an aluminium part A to be prepared before bonding.

The device according to the invention comprises a casing 1 having a side wall 2, a rear wall 3 and a front opening 4 opposite the rear wall 3 as shown in FIG. 1. This casing, which is made of insulating material, for example polypropylene or PVDF, delimits an internal space 5 in which a cathode 6 is accommodated facing the opening 4. This cathode has a rear face *6a* and a front face *6b*. This same cathode may, for example, have a circular, square or rectangular cross-section, the useful cathodic surface area being capable of varying between a few $mm^2$ to several $cm^2$. The cathode 6 is moreover held in the space 5 by any means and in particular by attachment of its rear face *6a* to the rear wall of the casing 1. In addition, the cathode 6 has dimensions such that on the one hand, it delimits with the internal face of the side wall 2 of the casing 1 a continual peripheral chamber and that, on the other hand, this front face *6b* is situated at a certain distance from the opening 4. The cathode 6 is connected to the "minus" terminal 7 of a generator G of current, in particular of pulsed current, the "plus" terminal 8 of which is connected to a point 9 of the part to be treated A. Furthermore, the cathode 6 is provided with a bore 10 commencing on its rear face *6a* and opening on its front face *6b*. Although a single bore is shown in FIG. 1, it is advantageous to provide several bores arranged in the cathode such that they open in a uniform manner over all the front face *6b*. This or these bores are connected, at the rear face *6a* of the electrode, by a connection 11, to an electrolyte inlet pipe 12.

The wall 2 of the casing 1 is furthermore provided with a bore 13 extending from the internal face of this wall 2 to the external face of the latter where it is connected by a connection 14 to an electrolyte outlet pipe 15 ending in an electrolyte reservoir R.

In accordance with the invention, the opening 4 is closed by a pad of absorbent material 16, the thickness of which is selected so that on the one hand, it is in contact with all the front face *6b* of the electrode 6 and on the other hand, it projects slightly beyond the said opening, it being specified that the bore 13 shall be made such that it opens into the space 5 at a point sufficiently distanced from the opening 4 so that this point is not covered by the said pad 16. As an example, this thickness may be 5 mm.

Moreover, the pipe 15 is connected to the suction of a pump 17 the discharge of which is connected to a pipe 18 which communicates with the electrolyte reservoir R.

The pipe 12 is connected to the discharge of a pump 19 the suction of which is connected to a pipe 20, the free end of which is immersed in the electrolyte in the reservoir R.

The operation of the device thus described is as follows.

The pumps 17 and 19 are chosen to have respective flow rates which enable an underpressure to be created inside the casing 1, that is to say in the peripheral chamber delimited by the internal face of the side wall 2 and the external surface of the electrode 6. These flow rates are in particular related to the area of the opening 4, the nature of the pad 16 and the thickness of the latter and it will be easy for those skilled in the art to define these flow rates by means of a few preliminary tests. As an indication, it will be noted that the ratio of the flow rate of the pump 17 to the flow rate of the pump 19 may for example be about 6.

Operation of the device thus described is as follows.

After any degreasing of the surface to be treated, the pumps 17 and 19 are put into action. In this way, the electrolyte E in the reservoir R is drawn out by the pump 19 and carried from the reservoir R via the pipe 20, the pump 19, the pipe 12 and the bore 10 to the pad 16 which thus becomes impregnated with electrolyte. The flow rate of the pump 19 is chosen such that a sufficient quantity of electrolyte arrives on the pad 16 in order to achieve anodic oxidation under good conditions. Furthermore, the pump 17 is chosen to have a flow rate which enables an underpressure to be created within the casing 1 without, in spite of this, drying the pad 16. Under the effect of this pump 17, excess electrolyte and a certain quantity of air drawn through the pad 16 are removed via the bore 13, the pipe 15, the pump 17 and the pipe 18, to the reservoir E. Thus any outflow of electrolyte over areas other than that to be treated is avoided.

The electrode 6 and the part A are then connected to the current generator G. The device is then operational for anodic oxidation and it is sufficient to move this device, manually or mechanically, over the surface to be treated S perpendicular to this surface.

The thickness of the oxide layer will depend in particular on the number of passes of the device over the area to be treated and the electrical parameters of the current generator G. These parameters may in particular be as follows:

current: direct, voltage: 60 V, intensity: from 0 to 15 A, density: from 250 to 350 $A/dm^2$.

Figure 3:
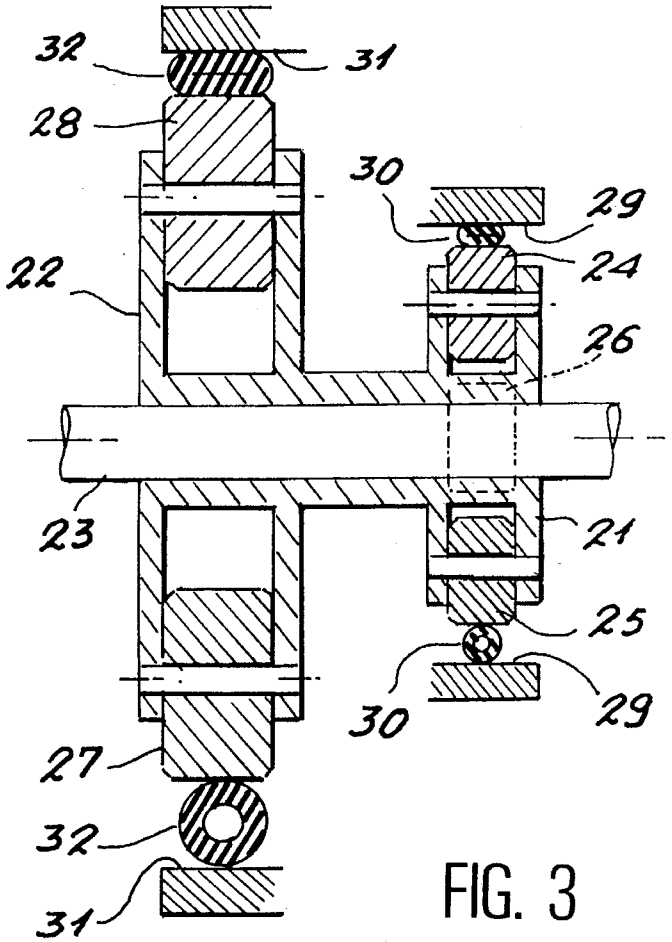
FIG. 3 is a cross-sectional view taken along line III—III in FIG. 2.
Figure 2:
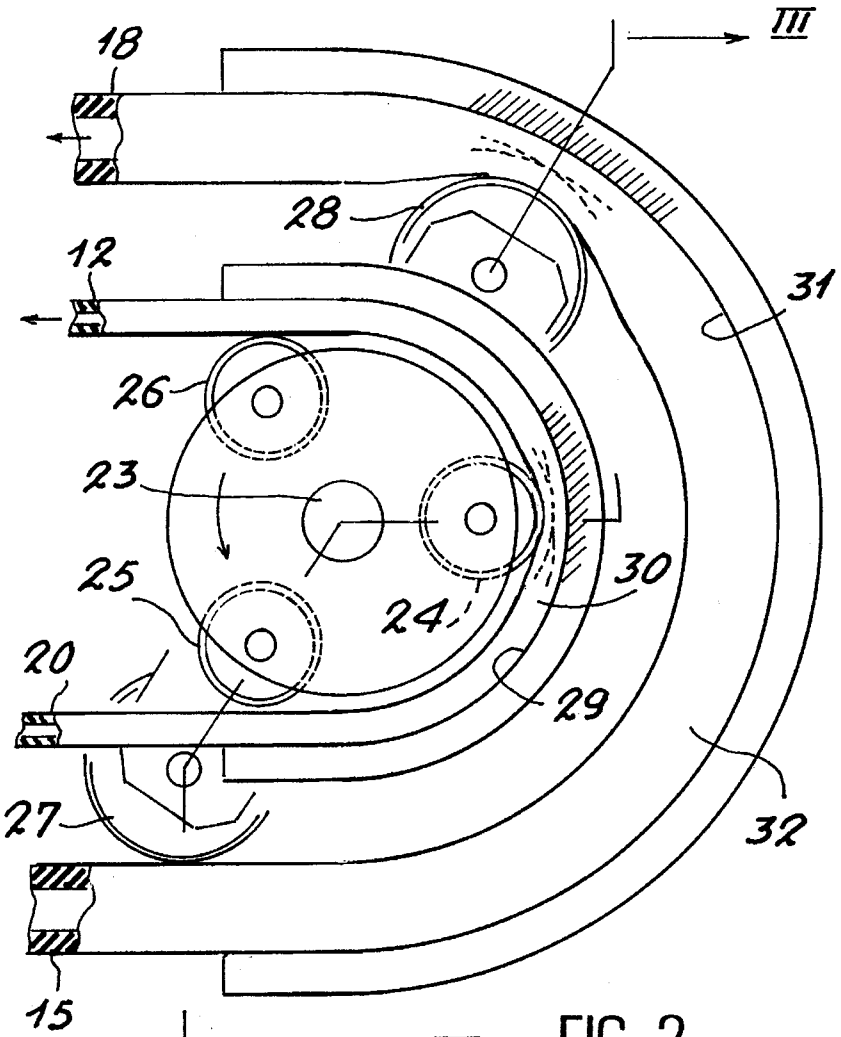
FIG. 2 is an elevational view of a pump in accordance with the subject invention.

According to the invention, the two pumps 17 and 19 are preferably peristaltic pumps represented diagrammatically and partially in FIG. 2 (elevated view) and 3 (cross sectional view along the line III—III of FIG. 2). These two pumps comprise two rotors 21, 22 both mounted axially on a common shaft 23 which may be rotated by a drive motor (not represented). The rotor 21 carries three equidistant rollers 24, 25 and 26 at its periphery and the rotor 22 carries two diametrically opposed rollers 27, 28 at its periphery. The said pumps moreover comprise a first semicircular bearing surface 29 to which a flexible tube 30 is applied, having a circular cross section, connecting the pipes 12 and 20 represented in FIG. 1, as well as a second bearing surface 31 to which a flexible tube 32 is applied having a circular cross section and connecting the pipes 15 and 18 represented in FIG. 1. The rotor 21 has a diameter and is arranged such that its rollers 24–26 compress the tube 30 against the bearing surface 29, squeezing it over all its diameter, so that when the rotor 21 is rotated, the said rollers, by moving along the tube 30, cause the electrolyte in this tube 30 to move forward. Similarly, the rotor 22 has a diameter and is arranged such that its rollers 27, 28 compress the tube 32 against the bearing surface 31, squeezing it over all its diameter, so that when the rotor 22 is rotated, the said rollers, by moving along the tube 32, cause the electrolyte in this tube 32 to move forward. The direction of rotation of the shaft 23, is such that the electrolyte moves forward in the tube 30 from the pipe 20 to the pipe 12 and, in tube 32, from the pipe 15 to the pipe 18. The diameter of the rotors 21 and 22 and/or the diameter of the flexible tubes 30, 32 are moreover chosen so that the rate of flow at the outlet from the tube 32 is greater than that exiting the tube 30 so as to create an underpressure within the internal space 5. Thus, for example, and as represented in FIGS. 2 and 3, the diameter of the rotor 22 and the diameter of the flexible tube 32 are respectively greater than the diameter of the rotor 21 and the diameter of the flexible tube 30.

It will be understood that the respective flow rates from the two pumps are connected and set once and for all and that stopping the motor driving the shaft 23 brings about simultaneous interruption of the supply of electrolyte to the electrolytic treatment device and the removal of excess electrolyte and aspirated air.

The device according to the invention can be used on parts having the most varied shapes and volumes and is not limited to plane surfaces. Thus, it may be used on surfaces to be treated which have dimensions from a few square centimeters to a few square decimeters or on joints between flat or "stepped" metal sheets or moreover on surfaces which are convex or have sharp edges. Surfaces to be treated may furthermore be at any angle and in particular retouching may be carried out in an inverted position.

It may be added that these electrochemical treatment retouching operations may, according to the invention, be carried out either at a fixed position in a laboratory or in a workshop, or in a mobile unit for on-site operations. In the latter case, benefit will advantageously be obtained from the total absence of leakage from the device whatever its position (this by virtue of the underpressure created by the two pumps).

I claim:

1. Device for localized electrochemical treatment of a conducting substrate by movement of said device over said substrate, said device being used with a source of electric current having a pair of terminals, said device being capable of being used in any position, which device comprises: a casing provided with an opening and delimiting a space, an electrode arranged in the space and being connectable to one of the terminals of the source of electric current, the conducting substrate being connectable to the other terminal of said source, and an electrolyte inlet and an electrolyte outlet both communicating with the space, characterized in that said device moreover comprises a body made of absorbent, flexible material which does not conduct electricity and which is permeable to gases and liquids, said body being in contact with the said electrode and closing off said opening, projecting beyond the latter, a first pump mounted on said electrolyte inlet and a second pump mounted on the said electrolyte outlet, said first and second pumps having a common driving shaft and the flow rate of the second pump being greater than that of the first pump so as to create in said space an underpressure sufficient to prevent any outflow of electrolyte through said opening.

2. Device according to claim 1, characterized in that the said electrolyte inlet opens into the said space in proximity to the said body made of absorbent material.

3. Device according to claim 2, characterized in that the electrolyte inlet comprises at least one bore made in the electrode and opening on the surface of the electrode in the area of contact between the latter and the said body made of absorbent material.

4. Device according to claim 2, characterized in that the said electrolyte outlet originates in the neighbourhood of the body made of absorbent material.

5. Device according to claim 2, characterized in that the said electrolyte inlet and the said electrolyte outlet each comprises a flexible tube and in that the said first and second pumps are peristaltic pumps which have two rotors provided with peripheral rollers and are axially mounted on a shaft which can be rotated, the rollers of one of the rotors operating on the flexible electrolyte inlet tube and the rollers of the other rotor operating on the flexible electrolyte outlet tube, and the diameters of the said rotors and/or the said flexible tubes being selected to create the said underpressure in the said space.

6. Device according to claim 2, characterized in that the said body is a woven or non-woven textile material, consisting of nylon fibres or felt.

7. Device according to claim 1, characterized in that the electrolyte inlet comprises at least one bore made in the electrode and opening on the surface of the electrode in the area of contact between the latter and the said body made of absorbent material.

8. Device according to claim 7, characterized in that the said electrolyte outlet originates in the neighbourhood of the body made of absorbent material.

9. Device according to claim 7, characterized in that the said electrolyte inlet and the said electrolyte outlet each comprises a flexible tube and in that the said first and second pumps are peristaltic pumps which have two rotors provided with peripheral rollers and are axially mounted on a shaft which can be rotated, the rollers of one of the rotors operating on the flexible electrolyte inlet tube and the rollers of the other rotor operating on the flexible electrolyte outlet tube, and the diameters of the said rotors and/or the said flexible tubes being selected to create the said underpressure in the said space.

10. Device according to claim 7, characterized in that the said body is a woven or non-woven textile material, consisting of nylon fibres or felt.

11. Device according to claim 1, characterized in that the said electrolyte outlet originates in the neighbourhood of the body made of absorbent material.

12. Device according to claim 11, characterized in that the said electrolyte inlet and the said electrolyte outlet each comprises a flexible tube and in that the said first and second pumps are peristaltic pumps which have two rotors provided with peripheral rollers and are axially mounted on a shaft which can be rotated, the rollers of one of the rotors operating on the flexible electrolyte inlet tube and the rollers of the other rotor operating on the flexible electrolyte outlet tube, and the diameters of the said rotors and/or the said flexible tubes being selected to create the said underpressure in the said space.

13. Device according to claim 11, characterized in that the said body is a woven or non-woven textile material, consisting of nylon fibres or felt.

14. Device according to claim 1, characterized in that the said electrolyte inlet and the said electrolyte outlet each comprises a flexible tube and in that the said first and second pumps are peristaltic pumps which have two rotors provided with peripheral rollers and are axially mounted on said common driving shaft which can be rotated, the rollers of one of the rotors operating on the flexible electrolyte inlet tube and the rollers of the other rotor operating on the flexible electrolyte outlet tube, and the diameters of the said rotors and/or the said flexible tubes being selected to create the said underpressure in the said space.

15. Device according to claim 14, characterized in that the said body is a woven or non-woven textile material, consisting of nylon fibres or felt.

16. Device according to claim 1, characterized in that the said body is a woven or non-woven textile material, consisting of nylon fibres or felt.

17. Device according to claim 1, characterized in that the source of electric current is a source of pulsed current or a source of direct current.

* * * * *